US007338200B2

(12) United States Patent
Hintze

(10) Patent No.: US 7,338,200 B2
(45) Date of Patent: Mar. 4, 2008

(54) PALLET-STONES FOR A CLOCKWORK MOVEMENT

(75) Inventor: Hans-Georg Hintze, Dippol Diswalde (DE)

(73) Assignee: Glashütter Uhrenbetrieb GmbH, Glashütte/Sachsen (DE)

( * ) Notice: Subject to any disclaimer, the term of this patent is extended or adjusted under 35 U.S.C. 154(b) by 271 days.

(21) Appl. No.: 11/227,294

(22) Filed: Sep. 16, 2005

(65) Prior Publication Data

US 2006/0062087 A1 Mar. 23, 2006

(30) Foreign Application Priority Data

Sep. 17, 2004 (EP) ..... 04022204

(51) Int. Cl.
*G04B 15/14* (2006.01)

(52) U.S. Cl. ..... 368/125; 368/131

(58) Field of Classification Search ..... 368/125, 368/124, 131

See application file for complete search history.

(56) References Cited

U.S. PATENT DOCUMENTS 2,685,165 A 8/1954 Accola ..... 368/125

FOREIGN PATENT DOCUMENTS

| | | |
|---|---|---|
| CH | 116857 | 10/1926 |
| CH | 321946 | 5/1957 |
| CH | 685463 | 7/1995 |
| CH | 690013 | 3/2000 |
| JP | 8-50183 * | 2/1996 |

OTHER PUBLICATIONS

European Search Report completed Mar. 14, 2005 in corresponding European Application No. EP04 02 2204.

* cited by examiner

*Primary Examiner*—Renee Luebke
(74) *Attorney, Agent, or Firm*—Griffin & Szipl, P.C.

(57) ABSTRACT

A pallet stone cooperates with the teeth of an escapement wheel of a watch or clock movement, and includes a trailing plane and an impulse plane and at least one capillary channel acting as a tank for a lubricant, characterized in that the capillary channel connects the trailing plane to the impulse plane.

9 Claims, 2 Drawing Sheets

PALLET-STONES FOR A CLOCKWORK MOVEMENT

This application claims priority from European Patent Application No. 04022204.4 filed Sep. 17, 2004, the entire disclosure of which is incorporated herein by reference.

FIELD OF THE INVENTION

The present invention generally concerns pallet-stones for escapement mechanisms in a watch movement. More specifically, the invention concerns pallet-stones having a channel acting as a lubricant tank for ensuing improved lubrication between the pallet stone and the teeth of the escapement wheel.

BACKGROUND OF THE INVENTION

Lubrication of watch movement escapements that have ruby pallet-stones is a difficult process. The process consisting in arranging a drop of lubricant on the teeth of the escapement wheel does not ensure lubrication over a long period of time in that the lubricant is quickly driven towards the locking plane of the pallet stone on which it accumulates, such that it is no longer available for the desired lubrication.

CH Patent No. 116 857 proposes to overcome this problem by piercing a capillary channel through the pallet stones which extends between the locking plane and the pallet stone trailing plane, the channel acting as a tank for the lubricant. One drawback of this arrangement lies in the fact that access to the channel is awkward, so that it is difficult to fill. Moreover, given the length of the channel, it is difficult to fill it without air bubbles entering therein and preventing the lubricant from flowing freely. It is also difficult to clean such channels.

CH Patent No. 685 463 attempts to overcome these drawbacks by proposing to arrange a groove, which is open outwards and which connects the locking plane to the back plane of the pallet, on at least one of the lateral faces of the pallet stone. In addition to the fact that the lubricant in the groove is exposed to the air and thus tends to deteriorate rapidly, the shock on the pallet stone at the moment of the impulse is liable to drive said lubricant out of the groove since the capillary effect in an open groove is less than that in a closed channel.

CH Patent No. 690 013 propose to overcome the aforementioned drawbacks by making a capillary slot open onto the locking, impulse and trailing planes and in which the lubricant is received. Such an embodiment is unfavourable to the working of the escapement since the tooth of the escapement wheel moves along two faces during the impulse, which can cause extra wear.

It is also known from U.S. Pat. No. 2,685,165 a pallet-stone wherein an open capillary channel is arranged in the impulse plane thereof. The arrangement of an open channel in the impulse plane has a drawback. Indeed, in operation, when the impulse plane of the tooth of the escapement wheel transmits the impulse on the pallet via the impulse beak of the pallet-stone, a local pressure which is very high is generated at the tooth, due the pointed geometry of the impulse beak and the small contact surface of the beak with the impulse plane of the tooth. This has the effect of marking and/or deforming the impulse plane of tooth of the escapement wheel taking into account the hardness difference between the tooth of the wheel and the pallet-stone and consequently affecting the operation of the escapement. The use of an open channel causes the contact surface between the impulse beak and impulse plane of the tooth to be reduced thereby increasing the local pressure and accelerating the aging of the system.

It is an object of the present invention to overcome the aforementioned drawbacks in addition to others by providing a pallet-stone for a watch movement that ensures improved and extended lubrication of the escapement.

SUMMARY OF THE INVENTION

The invention therefore concerns a pallet stone for cooperating with the teeth of an escapement wheel of a watch movement, said pallet stone including a trailing plane and an impulse plane and at least one capillary channel acting as a tank for a lubricant, characterized in that said capillary channel connects said trailing plane to said impulse plane and in that said capillary channel is a closed channel.

This configuration of the capillary channel which extends directly from the trailing plane to the impulse plane, allow the length of the capillary channel to be significantly reduced with respect to those of the prior art channels, without altering the quality of lubrication at the contact points between the pallet stone and the teeth of the escapement wheel. Typically, the pallet stone according to the invention enables a channel length reduction of the order of 30%. Since the length of the capillary channel is shortened with respect that of the prior art channels, the problem of bubble creation in the channel is less critical and it is easier to clean the channel. It will be noted that, surprisingly, owing to the arrangement of the invention, there is sufficient lubricant quantity on the locking plane without the channel in question being connected with said plane.

Moreover, this closed channel configuration allows the local contact pressure between the teeth of the escapement wheel and the pallet-stones during operation to be considerably reduced, thereby reducing the wear and tear of the teeth of the escapement wheel in a significant manner.

According to an advantageous embodiment, the channel opens out into the first third of the impulse plane starting from the exit edge of the impulse plane.

According to a preferred feature, the channel cross section has a variable profile over its entire length and the channel is preferably frustro conical and converges in the direction of the impulse plane.

The tapering of the capillary channel advantageously allows direction to be given to the movement of the lubricant in the channel, the lubricant being drawn by capillary action towards the impulse plane when the tooth passes over the impulse plane.

According to yet another preferred feature of the invention, the dimension of the channel at the place where it opens onto the impulse plane is less than the thickness of the escapement wheel teeth. Thus, the escapement wheel teeth are prevented from penetrating the part of the capillary channel that opens onto the impulse plane and premature wear is thereby avoided. It goes without saying that the escapement will be regulated such that the escapement wheel teeth pass opposite the channel and are preferably centred in relation to the channel when they rotate. It will also be noted that the pallet stone according to the invention allows the use of escapement wheels whose teeth do not comprise the bevel usually made to concentrate the lubricant on the friction surface, in this case on the impulse plane.

BRIEF DESCRIPTION OF THE DRAWINGS

Other features and advantages of the present invention will appear more clearly upon reading the following description of embodiment examples, said description being given in a non-limiting manner and in relation to the annexed drawings, in which.

DETAILED DESCRIPTION OF THE ILLUSTRATIVE EMBODIMENTS

Figure 1:
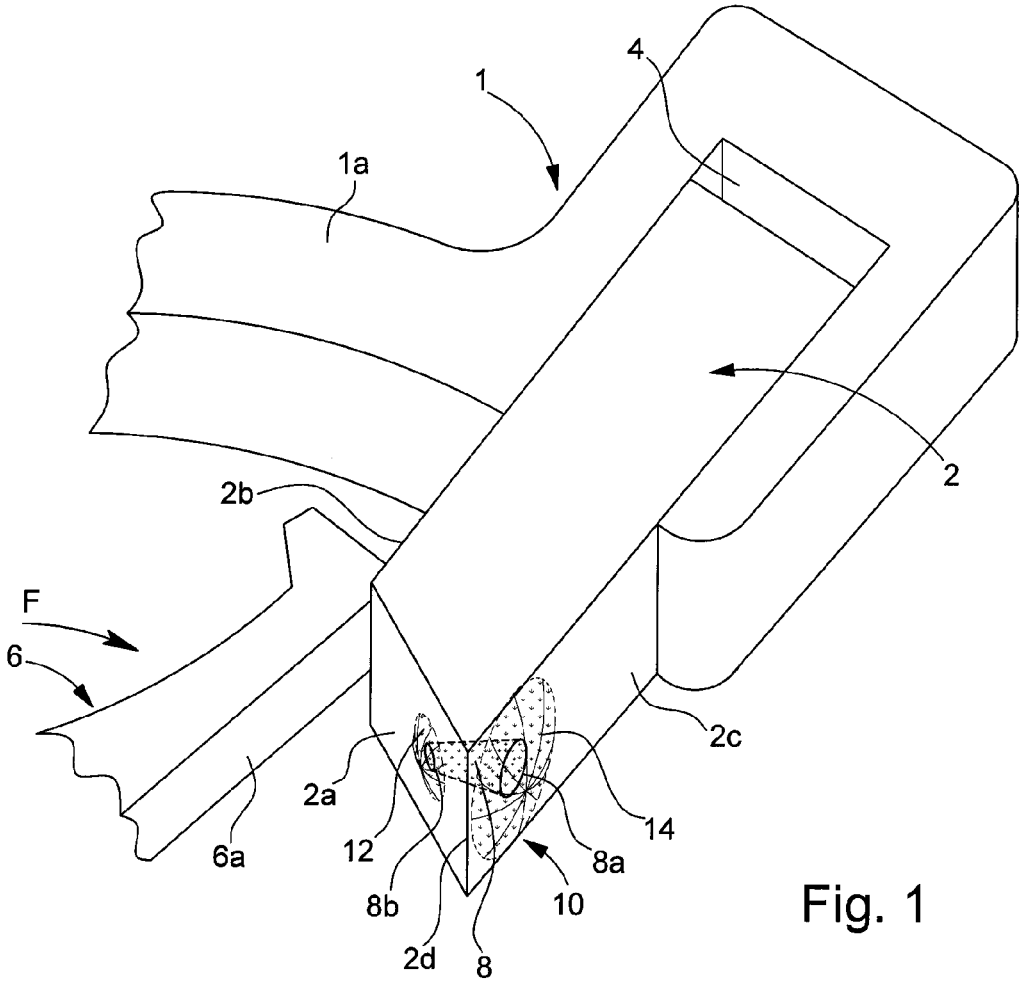
FIG. 1 shows in perspective a pallet stone according to the invention against which one flank of an escapement wheel tooth abuts.

Referring to FIG. 1, a pallet 1 is shown having a conventional structure, carrying two pallet stones 2 (only the exit pallet having been shown in the drawing). Pallet stone 2 is generally a part made of ruby all of the faces of which are polished and which is driven and bonded into a housing 4 arranged in the arm 1*a* of the pallet 1. Pallet stone 2 comprises an impulse plane 2*a*, a locking plane 2*b* and a trailing plane 2*c*, impulse plane 2*a* and trailing plane 2*c* intersecting along an exit edge or impulse beak 2*d*. Impulse plane 2*a* and locking plane 2*b* cooperate respectively with the escapement wheel teeth 6 and more specifically with locking plane 6*a* and locking beak 6*b* of teeth 6. Escapement wheel 6 rotates in a conventionally stepping manner in the direction or arrow F. The particularly important lubrication points are thus the impulse plane 2*a* and locking plane 2*b* such that the presence of a lubricant between the escapement wheel teeth and these planes is necessary during the various operating phases of the escapement.

In order to do this, pallet stone 2 comprises a channel 8 whose dimensions enable it to behave like a capillary tube as regards lubricant 10 while also acting as a tank for the lubricant. It will be noted in this respect that the channel can advantageously be made using a suitably parametrized laser beam.

According to the invention, capillary channel 8 connects said trailing plane 2*c* to said impulse plane 2*a* and thus establishes communication between these two planes. Channel 8 comprises a lubricant entry orifice 8*a* arranged in trailing plane 2*c* and a lubricant exit orifice 8*b* opening into impulse plane 2*a*. Entry orifice 8*a* is located in proximity to impulse beak 2*d* whereas exit orifice 8*b* is located in the first third of impulse plane 2*a* from impulse beak 2*d*. This configuration reduces the length of capillary channel 8 in relation to the channels of the prior art, which prevents, in particular, the formation of bubbles in the channel and thus the lubricant becoming blocked therein. In the embodiment illustrated in the Figures, it can be seen that channel 8 opens out substantially in the first third of impulse plane 2*a*. Typically, this configuration reduces the length of the channel by approximately 30% to attain approximately 0.12 mm. Preferably, in the illustrated example, channel 8 thus extends in the plane of symmetry of pallet stone 2. It can also be seen that the cross section of channel 8 has a variable profile over its entire length and gradually decreases from entry orifice 8*a* towards exit orifice 8*b*. In the illustrated example, channel 8 thus has a frustro conical shape convergent in the direction of impulse plane 2*a*. The tapering of the channel is typically comprised between 3° and 10° and is preferably of the order of 6°. According to a variant, the cross section of channel 8 can also be constant. In the case of a pallet stone comprising one channel 8, the latter typically has a mean diameter of the order of 3/100 mm.

Lubricant 10. Which is deposited on trailing plane 2*c* of pallet stone 2 in the form of a drop is introduced by capillary action into channel 8 and fills the latter up to exit orifice 8*b* at which a drop 12 forms, which slightly projects from impulse plane 2*a*. The quantity of lubricant deposited on trailing plane 2*c* is greater than the volume of the channel such that once channel 8 is filled, a drop 14 also forms on trailing plane 2*c* around entry orifice 8*a* of channel 8.

Figure 2:
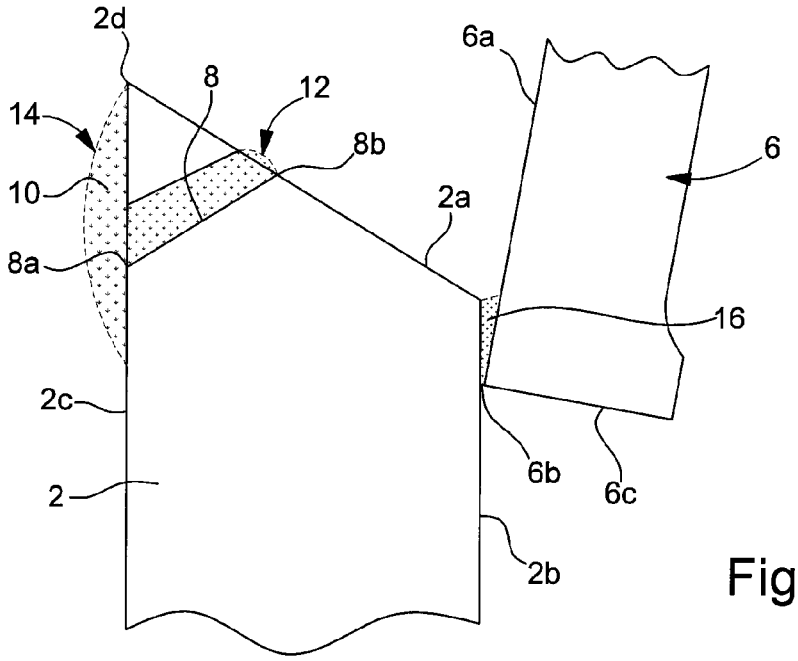
FIG. 2 shows a pallet stone and a tooth of an escapement wheel during the locking phase.

FIG. 2 shows pallet stone 2 and one tooth 6 of the escapement wheel during the locking phase, i.e. when the locking plane 6*a* of tooth 6 rests on pallet stone locking plane 2*a* such that the escapement wheel is stopped. It can be seen that a film of lubricant 16 is inserted between locking plane 6*a* of tooth 6 and locking plane 2*b* of pallet stone 2.

Figure 3:
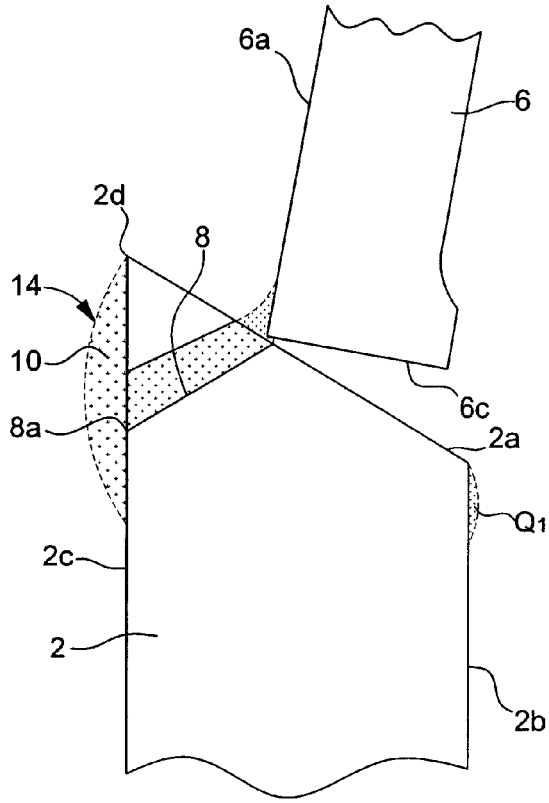
FIG. 3 shows the tooth after leaving the locking plane, as it sweeps over the impulse plane.
Figure 4:
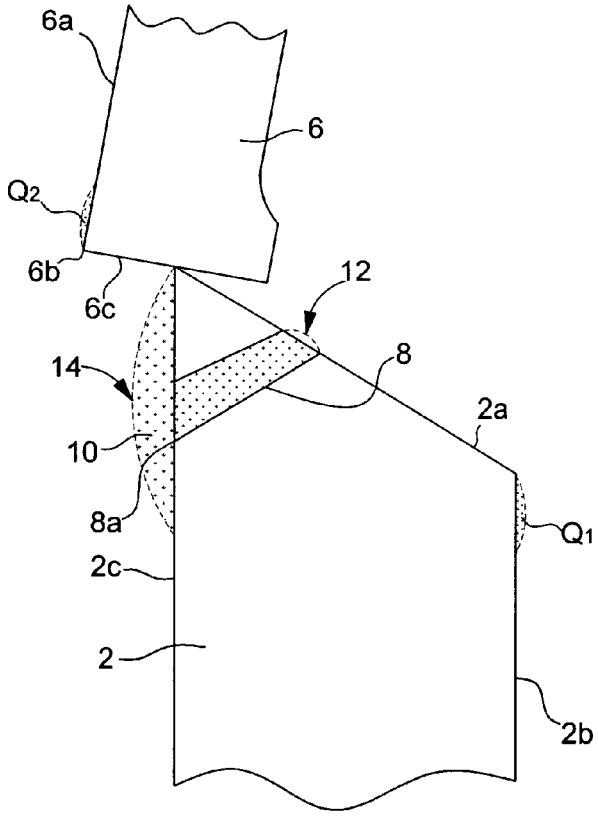
FIG. 4 shows the tooth just before the end of the impulse.

During the next phase shown in FIG. 3, the locking beak 6*b* of tooth 6 that carries a small quantity of lubricant on its locking plane 6*a* and in the area of its locking beak 6*b*, leaves locking plane 2*b* of pallet stone 2, leaving a small quantity of lubricant Q1 on locking plane 2*b* of pallet stone 2. Locking beak 6*b* of tooth 6 then sweeps the surface of impulse plane 2*a* passing over drop 12. Before locking beak 6*b* passes over drop 12, the lubricant deposited around the latter is then sufficient to lubricate the friction surfaces of the tooth and pallet stone. When the locking plane of the tooth passes over the drop, the latter causes a small quantity of lubricant to leave channel 8. Channel 8 is then again filled from drop 14 deposited on the entry orifice. Lubricant Q2 removed by the tooth spreads around locking plane 6*b* as illustrated in FIG. 4, which shows the position of tooth 6 in relation to pallet stone 2 just before the end of the impulse, impulse beak 2*d* sliding over impulse plane 6*c* of tooth 6. Escapement wheel 6 is then ready to cooperate, via locking plane 6*a* of the next tooth 6, with locking plane 2*b* of pallet stone 2, the quantities of lubricant Q1 and Q2 again forming the film of lubricant 16 when the locking plane of tooth 6 again rests against the locking plane of pallet stone 2. When the escapement is operating, a lubricant circuit is thus formed which only returns the lubricant from pallet stone trailing plane 2*c* onto locking plane 2*b*, but which, against all expectations, provides sufficient and continuous lubrication of the friction surfaces of the pallet stones, particularly locking plane 2*b*, during the various operating phases of the escapement. This lubrication is of course ensured until the store of lubricant formed by lubricant drop 12 deposited on trailing plane 2*c* and the lubricant contained in channel 8 is completely exhausted, despite the fact that exit orifice 8*b* of channel 8 does not open onto locking plane 2*b* of pallet stone 2.

It will be noted that when the escapement mechanism is assembled, care must be taken to ensure that the escapement wheel is adjusted in relation to the pallet stones such that, when the wheel rotates, the teeth pass opposite channel 8 to remove the lubricant necessary to supply the lubricant circuit. In this regard, and particularly to prevent the teeth penetrating the exit orifice 8*b* when they pass over impulse plane 2*a*, it will also be noted that the thickness of the teeth must be greater than the diameter of exit orifice 8*b* of the channel. Typically, this thickness will be two times greater than the diameter of the exit orifice.

Although the present invention has been described in relation to particular embodiments, it is clear, however, that it is not limited to said examples and that numerous variants and alterations are possible without departing from the scope defined by the annexed claims. For example, according to a variant of the invention, two or several parallel capillary channels could be provided, extending between the locking plane and the impulse plane. It will also be noted that the invention is of course applicable to any type of escapement comprising pallet stones, whether the pallet stones are affixed to or form one piece with the part acting as the pallet.

What is claimed is:

1. A pallet stone for cooperating with the teeth of an escapement wheel of a watch or clock movement, said pallet stone including a trailing plane and an impulse plane and a capillary channel acting as a tank for a lubricant wherein said capillary channel connects said trailing plane to said impulse plane and wherein said capillary channel is a closed channel.

2. The pallet stone according to claim 1, wherein the channel opens out into a first third of the impulse plane from an exit edge of the impulse plane.

3. The pallet stone according to claim 2, wherein the cross section of the channel has a variable profile over an entire length of the channel.

4. The pallet stone according to claim 1, wherein a cross section of the channel has a variable profile over an entire length of the channel.

5. The pallet stone according to claim 4, wherein the channel is frustroconical truncated in shape and converges in the direction of the impulse plane.

6. The pallet stone according to claim 5, wherein the tapering of the channel is comprised between 3 and 10°.

7. The pallet stone according to claim 5, wherein the tapering of the channel is approximately 6°.

8. The pallet stone according to claim 1, wherein a dimension of the channel at a place where the channel opens onto the impulse plane is less than a thickness of the escapement wheel teeth.

9. The pallet stone according to claim 1, wherein a mean diameter of the channel is approximately 3/100 mm.

* * * * *